US009414143B2

(12) United States Patent
Akino

(10) Patent No.: US 9,414,143 B2
(45) Date of Patent: Aug. 9, 2016

(54) MICROPHONE

(71) Applicant: Hiroshi Akino, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 14/699,493

(22) Filed: Apr. 29, 2015

(65) Prior Publication Data

US 2015/0341715 A1 Nov. 26, 2015

(30) Foreign Application Priority Data

May 26, 2014 (JP) ..... 2014-107821

(51) Int. Cl.
*H04R 21/02* (2006.01)
*H04R 1/04* (2006.01)

(52) U.S. Cl.
CPC ..... *H04R 1/04* (2013.01)

(58) Field of Classification Search
CPC ..... H04R 1/04; H04R 1/08
USPC ..... 381/355, 361, 362, 189
See application file for complete search history.

(56) References Cited

U.S. PATENT DOCUMENTS

2007/0036361 A1* 2/2007 Akino ..... H04R 1/04 381/26
2012/0263334 A1* 10/2012 Yoshino ..... H04R 1/086 381/363

FOREIGN PATENT DOCUMENTS

JP 2012-222774 11/2012

* cited by examiner

*Primary Examiner* — Sunita Joshi
(74) *Attorney, Agent, or Firm* — Whitham, Curtis & Cook, P.C.

(57) ABSTRACT

A microphone 1 includes a circuit board 22 equipped with electronic circuits, a microphone unit 26, and a case 21 accommodating the circuit board 22 and the microphone unit 26. The case 21 is a resilient hollow cylinder. The circuit board 22 has a substantially rectangular shape and has shorter sides having a length substantially equal to the inner diameter of the case 21. The circuit board 22 includes contact adapters 222 in contact with the inner wall of the case 21, along the longer sides of the circuit board 22.

12 Claims, 12 Drawing Sheets

MICROPHONE

TECHNICAL FIELD

The present invention relates to a microphone.

BACKGROUND ART

Electret condenser microphones, which can be made compact, are suitable as tie-pin microphones or gooseneck microphones for conference rooms.

Some gooseneck microphones include circuit boards in the vicinity of the microphone units. The circuit boards are each equipped with electronic circuits, such as an impedance converter, a tone control circuit, and a balanced output circuit.

The gooseneck microphones including electronic circuits in the vicinity of the microphone units are resistant to noise caused by external electromagnetic waves, because of the short wires between the circuits.

Unfortunately, a case to accommodate a circuit board for a typical traditional gooseneck microphone cannot be readily made compact because of difficulty in providing a structure for fixing the circuit board to the case.

The circuit board in such a traditional compact gooseneck microphone is thus placed in the case directly or with a sponge for absorbing vibrations. In other words, the circuit board is not firmly fixed inside the case in the traditional compact gooseneck microphone.

In addition, the circuit board and the case in the traditional gooseneck microphone cannot be readily wired to each other and thus have poor electrical connection. The high impedance at the contact results in poor grounding of the circuit board in the traditional gooseneck microphone. Hence, the traditional gooseneck microphone is not completely resistant to noise caused by RF current and external noise.

Besides, the traditional gooseneck microphone, which includes the circuit board not firmly fixed to the case, has problems of low stability of the circuit board inside the case and low productivity.

In order to solve the problems, techniques are disclosed for reducing the noise caused by external electromagnetic waves in gooseneck microphones (for example, refer to Japanese Unexamined Patent Application Publication No. 2012-222774 (PTL 1)).

Unfortunately, the technique disclosed in PTL 1 is directed to the shielding of an output module and not an improvement in the fixation of the circuit board to the case for better electrical connection therebetween.

SUMMARY OF INVENTION

Technical Problem

An object of the invention is to provide a microphone including a circuit board firmly fixed to its case.

Solution to Problem

A microphone according to the invention includes a circuit board equipped with electronic circuits, a microphone unit, and a case accommodating the circuit board and the microphone unit. The case is a resilient hollow cylinder. The circuit board has a substantially rectangular shape. The shorter sides of the circuit board have a length substantially equal to the inner diameter of the case. The circuit board includes contact adapters in contact with the inner wall of the case, along the longer sides of the circuit board.

Advantageous Effects of Invention

The invention can provide a microphone including a circuit board firmly fixed to its case.

DESCRIPTION OF EMBODIMENTS

A microphone according to an embodiment of the invention will now be described with reference to the accompanying drawings.

Figure 1:
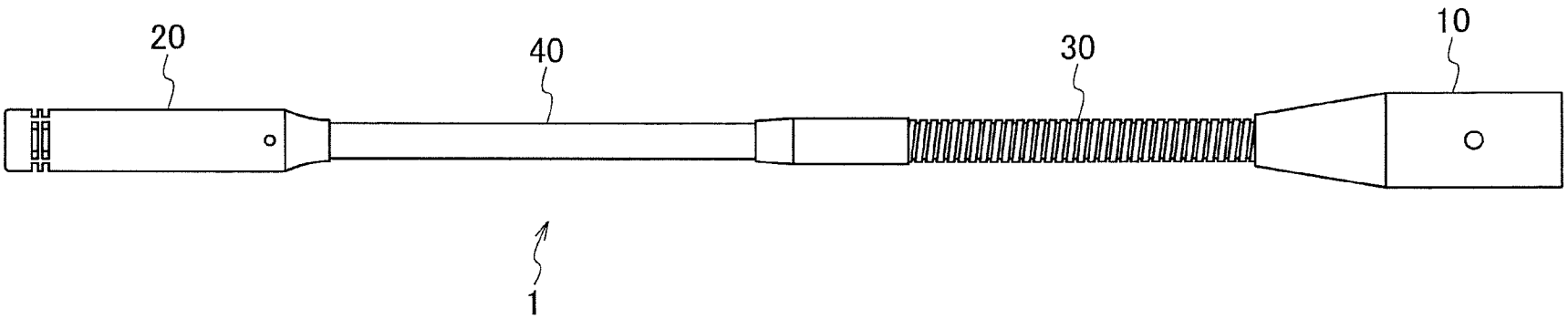
FIG. 1 is a side view of a microphone according to an embodiment of the invention.

FIG. 1 is a side view of a microphone 1 according to the embodiment of the invention. The microphone 1 in FIG. 1 is a gooseneck microphone. With reference to FIG. 1, the microphone 1 includes a microphone body 20 including a microphone unit and a circuit board (which are described below), and a support pipe 40 supporting the microphone body 20.

The microphone 1 also includes a flexible pipe 30 supporting the support pipe 40 and a base housing 10 supporting the flexible pipe 30. The base housing 10 has an output connector.

Figure 2:
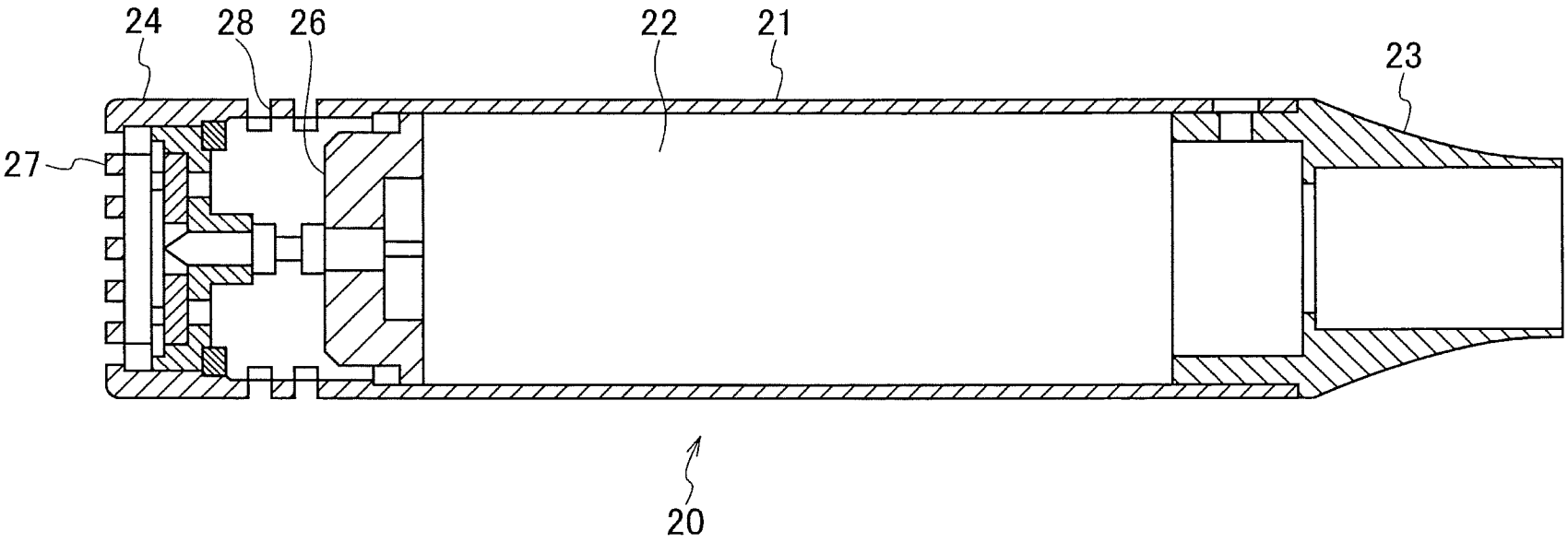
FIG. 2 is a longitudinal sectional view of a microphone body of the microphone illustrated in FIG. 1.

FIG. 2 is a longitudinal sectional view of the microphone body 20. With reference to FIG. 2, the microphone body 20 has openings at both ends. The microphone body 20 includes a cylindrical case 21, which defines the contour of the microphone body 20. The case 21 accommodates a circuit board 22 equipped with electronic circuits for the microphone 1.

The opening of the case 21 adjacent to the support pipe 40 is covered with a tailpiece 23. The other opening of the case 21 remote from the tailpiece 23 (adjacent to the tip of the microphone 1) is provided with a unit case 24 surrounding a microphone unit 26.

Figure 3:
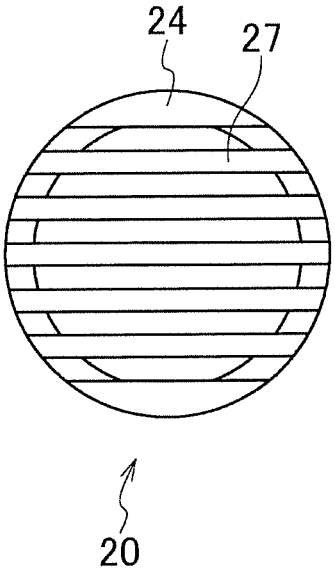
FIG. 3 is a front view of the microphone body illustrated in FIG. 2.

FIG. 3 is a front view of the microphone body 20. With reference to FIGS. 2 and 3, the unit case 24 has a front sound entrance 27 and a rear sound entrance 28 to introduce sound waves into the microphone unit 26.

The following description focuses on the specific components of the microphone body 20.

Figure 4:
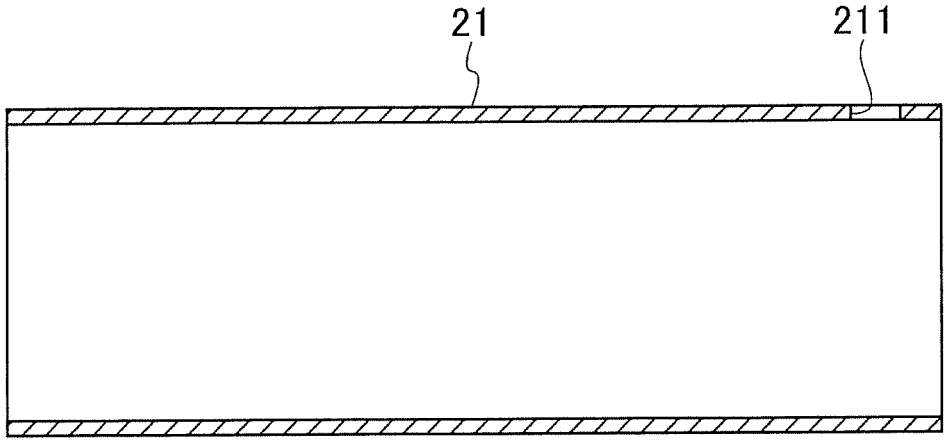
FIG. 4 is a longitudinal sectional view of a case of the microphone body illustrated in FIG. 2.

FIG. 4 is a longitudinal sectional view of the case 21. With reference to FIG. 4, the case 21 is a hollow substantially cylindrical component having openings at both ends in the longitudinal direction. The case 21 is composed of a conductive and elastically deformable material (hereinafter also referred to as "resilient material"), such as brass, having a thickness of approximately 0.5 mm, for example. The case 21 has a through hole 211 on the side face in the vicinity of the opening adjacent to the support pipe 40. A screw is passed through the through hole 211 for fastening the tailpiece 23 to the case 21.

The resilient material of the case 21 may alternatively be a resin, such as a plastic, instead of a metal. In such a resin case 21, at least the inner wall should be plated to have conductivity. If the outer wall of the case 21 is also plated to provide continuity between the outer wall and the inner wall, the case 21 has increased electrostatic shielding effects. Such a case 21 can contribute to a reduction in the weight of the microphone.

Figure 5:
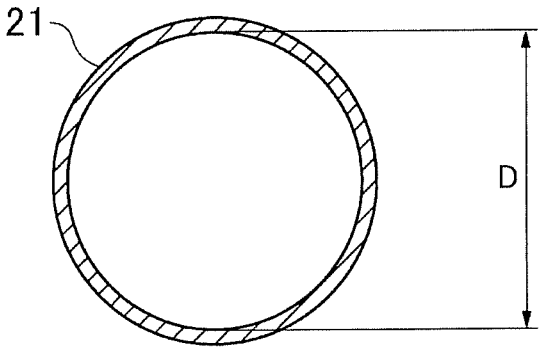
FIG. 5 is a cross sectional view of the case illustrated in FIG. 4.

FIG. 5 is a cross sectional view of the case 21. With reference to FIG. 5, the case 21 has a substantially circular cross section having an inner diameter D equal or substantially equal to the length of the shorter sides of the circuit board 22 in a static state (under no external force in the radial direction of the case 21).

Figure 6:
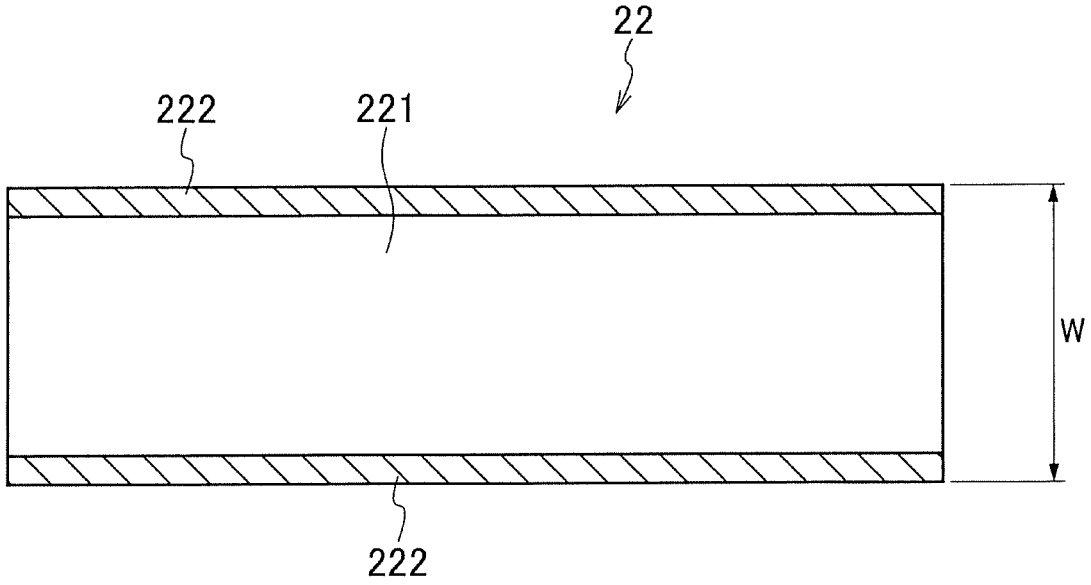
FIG. 6 is a side view of a circuit board in the microphone body illustrated in FIG. 2.

FIG. 6 is a side view of the circuit board 22. With reference to FIG. 6, the circuit board 22 is a rectangular or substantially rectangular circuit board, such as a printed circuit board (PCB). The length W of the shorter sides of the circuit board 22 corresponds to (i.e., is equal or substantially equal to) the inner diameter D of the case 21 such that the case 21 can accommodate the circuit board 22.

The circuit board 22 includes a conductive pattern 221 on the flat surface. Electronic components are disposed on the conductive pattern 221, forming electronic circuits, such as an impedance converter, a tone control circuit, and a balanced output circuit. The conductive pattern 221 resides on one or both surfaces of the circuit board 22. In the circuit board 22 including the conductive pattern 221 on both surfaces, a solid conductive pattern 221 on one surface can serve as a ground pattern on the circuit board 22.

Figure 7:
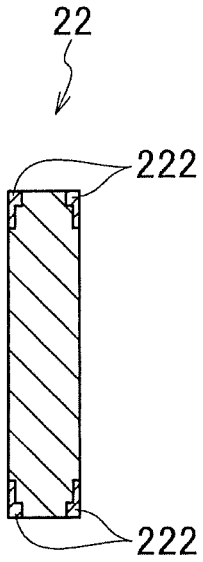
FIG. 7 is a cross sectional view of the circuit board illustrated in FIG. 6.

FIG. 7 is a cross sectional view of the circuit board 22. With reference to FIGS. 6 and 7, the circuit board 22 includes conductive contact adapters 222 along the side surfaces around the edges along the longer sides. The contact adapters 222 are connected to the ground of the conductive pattern 221. The contact adapters 222 is also provided along the sides in the thickness direction of the circuit board 22, so as to be in contact with the inner wall of the case 21 accommodating the circuit board 22.

The ground of the circuit board 22 is electrically connected to the case 21 via the contact adapters 222 in contact with the inner wall of the case 21. This brings the ground of the circuit board 22 at the same potential as the case 21 and thus at the reference potential.

The contact adapters 222 may be continuous or intermittent along the entire longer sides of the circuit board 22. The contact adapters 222 in FIG. 7 are given for illustration. For example, the contact adapters 222 may alternatively be copper foil tapes soldered to the ground of the circuit board 22.

Figure 8:
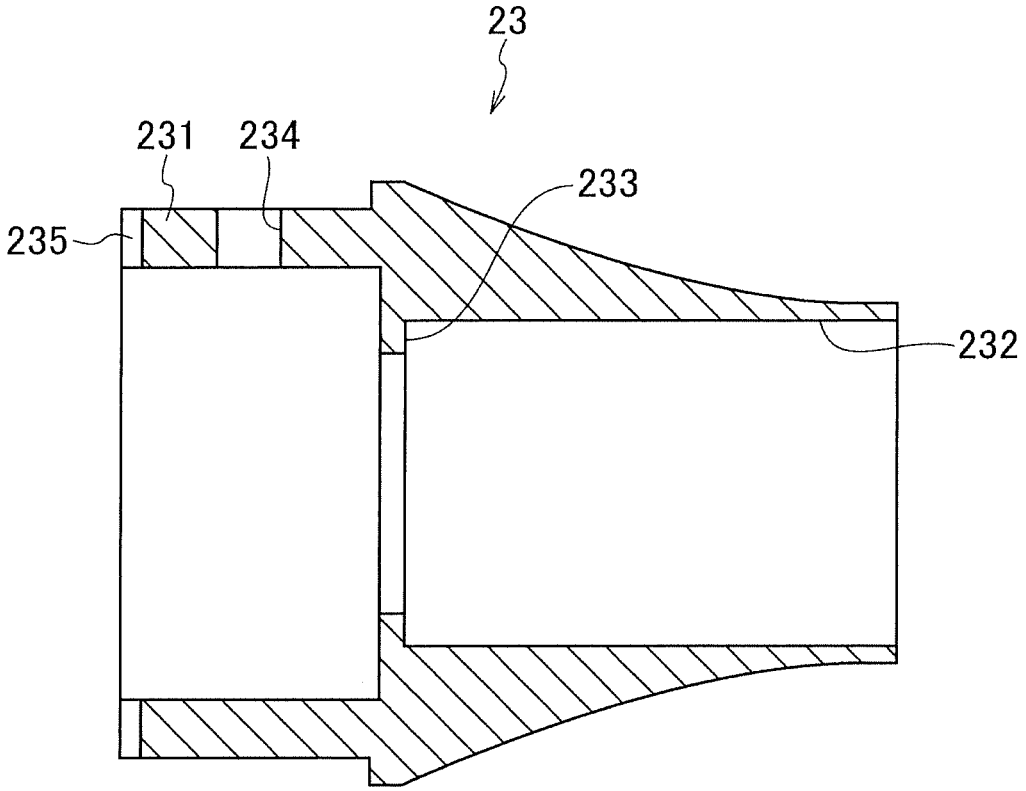
FIG. 8 is a longitudinal sectional view of a tailpiece of the microphone body illustrated in FIG. 2.

FIG. 8 is a longitudinal sectional view of the tailpiece 23. With reference to FIG. 8, the tailpiece 23 includes a plug 231 to be fitted in the opening of the case 21, at an end in the longitudinal direction.

The tailpiece 23 has an internal space 232 passing therethrough in the longitudinal direction. The tailpiece 23 consists of the plug 231 having a hollow cylindrical shape and a tapered segment gradually decreasing in diameter toward the tip.

A wire may be passed through the internal space 232. The internal space 232 is partitioned by a step 233 into a larger diameter section adjacent to the case 21 and a smaller diameter section adjacent to the support pipe 40. The screw inserted in the through hole 211 reaches a screw hole 234 which is on the side face of the plug 231.

The plug 231 has a substantially circular cross section, e.g., a perfectly circular or elliptical cross section fitted to the shape of the opening of the case 21. In specific, the cross section of the plug 231 is an ellipse having a minor axis and a major axis that is slightly longer than the inner diameter D of the case 21. The tailpiece 23 is composed of a resilient material, such as a rigid plastic, and can thus be readily fitted in the case 21.

The plug 231 of the tailpiece 23 may have grooves 235 at the end adjacent to the case 21 such that the circuit board 22 is fitted in the grooves 235. The grooves 235 are aligned along the center line of the cross section of the tailpiece 23. The circuit board 22 is fixed inside the case 21 after being fitted in the grooves 235.

[Assembly Process of Microphone Body]

An assembly process of the microphone body 20 will now be explained.

Figure 9:
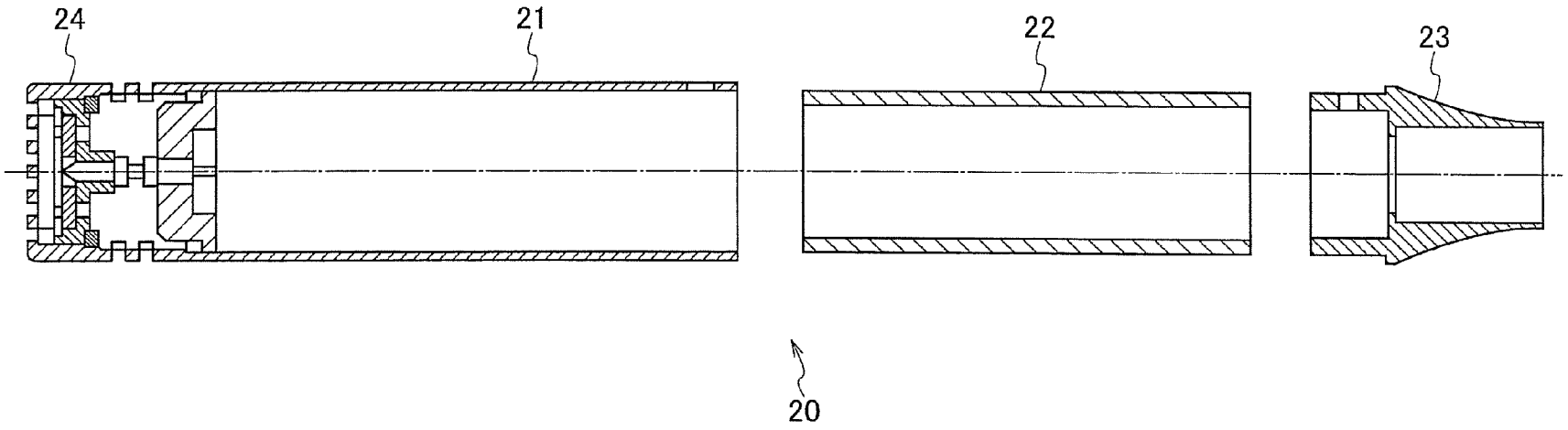
FIG. 9 is an exploded longitudinal sectional view for illustrating an assembly process of the microphone body illustrated in FIG. 2.

FIG. 9 is an exploded longitudinal sectional view for illustrating the assembly process of the microphone body 20. With reference to FIG. 9, the unit case 24 is fitted in one of the openings of the case 21. The circuit board 22 is inserted in the case 21 through the other opening of the case 21, and the tailpiece 23 is then fitted in the other opening.

Figure 10:
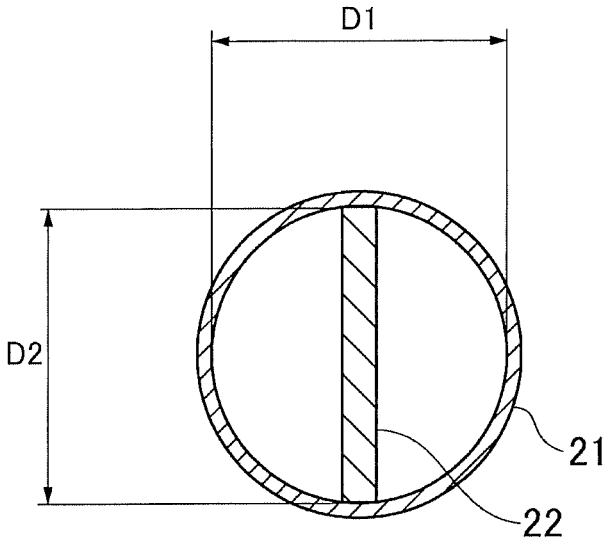
FIG. 10 is a cross sectional view of the case illustrated in FIG. 4 during the insertion of the circuit board illustrated in FIG. 6.

FIG. 10 is a cross sectional view of the case 21 during the insertion of the circuit board 22. With reference to FIG. 10, in order to insert the circuit board 22 into the case 21, the case 21 is deformed by external force on two sides of the case 21, such that the cross section of the case 21 becomes an ellipse.

In FIG. 10, the elliptical cross section of the case 21 has a major axis D2 (D2>W, D2>D) parallel to the shorter sides (width) of the circuit board 22 and a minor axis D1 (D1<W, D1<D) perpendicular to the shorter sides of the circuit board 22. The case 21 can be elastically deformed without being plastically deformed (below the yield point).

Figure 11:
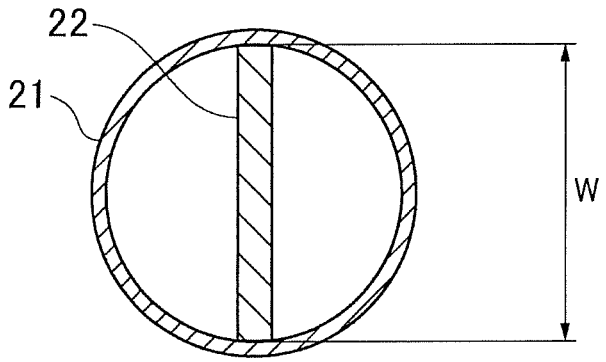
FIG. 11 is a cross sectional view of the case illustrated in FIG. 4 after the insertion of the circuit board illustrated in FIG. 6.

FIG. 11 is a cross sectional view of the case 21 after the insertion of the circuit board 22. With reference to FIG. 11, after the insertion of the circuit board 22 in the case 21, the external force on the two sides is removed, so that the case 21 restores a circular cross section having an inner diameter D.

Figure 12:
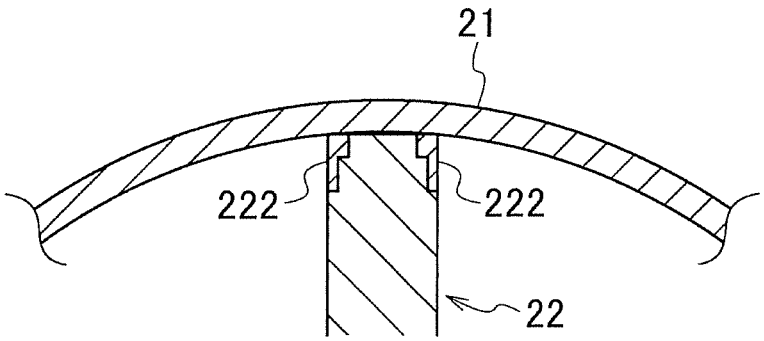
FIG. 12 is an enlarged cross sectional view of a joint between the case illustrated in FIG. 4 and the circuit board illustrated in FIG. 6.

FIG. 12 is a partially enlarged view of FIG. 11. With reference to FIG. 12, the circuit board 22 is disposed along a virtual line passing through the center of the cross section of the cylindrical case 21 (i.e., the diameter of the cylindrical case 21) in the microphone body 20. The contact adapters 222 of the circuit board 22 are in contact with the inner wall of the cylindrical case 21, so that the circuit board 22 is fixed inside the case 21.

After the insertion of the circuit board 22 in the case 21, the tailpiece 23 having a substantially circular cross section is fitted in the opening of the case 21. Fitting the tailpiece 23 in the opening generates force that deforms the case 21, which has an elliptical cross section due to the inserted circuit board 22.

The cross section of the plug 231 of the tailpiece 23 may be an ellipse. The plug 231 of the tailpiece 23 is fitted in the opening of the case 21 such that the major axis of the elliptical cross section of the plug 231 is perpendicular to the width of the circuit board 22. The circuit board 22 disposed along the minor axis of the elliptical cross section of the plug 231 expands the tailpiece 23 toward the direction perpendicular to the width of the circuit board 22. The circuit board 22 is thus fixed inside the case 21 with sufficient strength.

The specific means and structures in the above embodiment should not be construed to limit the microphone according to the invention, and may be modified within the summary of the invention.

[Advantageous Effects of Embodiment]

As described above, the microphone body 20 according to the embodiment can provide advantageous effects summarized below.

In the microphone body 20, the circuit board 22 is inserted in the case 21 composed of a resilient material through the deformation of the case 21, so that the circuit board 22 can be firmly fixed to the case 21.

Accordingly, the circuit board 22 can reduce vibrations of the case 21 and thus the noise caused by the vibrations in the microphone body 20 according to the embodiment. In other words, the microphone body 20 according to the embodiment prevents the characteristic vibrations of the case 21.

The microphone body 20 according to the embodiment does not require a vibration absorber, such as a sponge, which is used to fix a circuit board in a traditional microphone body.

In the microphone body 20 according to the embodiment, the circuit board 22 can be readily fixed to the case 21. The inserted circuit board 22 provides the same strength as a radial frame disposed inside the case 21. Such high strength can stabilize the electrical capacitance and reduce the noise caused by fluctuations in the electrostatic capacitance.

In the microphone body 20, the case 21 having a substantially circular cross section can be deformed by external force and can thus readily accommodate the rectangular circuit board 22.

The microphone body 20 has increased electromagnetic shielding effects due to the connection between the conductive case 21 and the contact adapters 222 (of the circuit board 22) provided with a conductive pattern.

In the microphone body 20, the tailpiece 23 having a circular or elliptical cross section fitted to the cross section of the case 21 is attached to an end of the case 21 in the longitudinal direction and can thus deform the cross section of the case 21.

In the microphone body 20, the tailpiece 23 has the grooves 235 to fit the circuit board 22 and can thus certainly retain the circuit board 22.

The invention claimed is:

1. A microphone comprising:

a circuit board provided with electronic circuits;

a microphone unit; and a case having an inner wall and an inner diameter, the case accommodating the circuit board and the microphone unit, wherein the case is a resilient hollow cylinder, and the circuit board has a substantially rectangular shape and has shorter sides having a length substantially equal to the inner diameter of the case, the circuit board comprising at least one contact adapter provided on a longer side of the circuit board, the contact adapter being in contact with the inner wall of the case.

2. The microphone according to claim 1, wherein the case has a substantially circular cross section.

3. The microphone according to claim 1, wherein the inner wall of the case is conductive, and the contact adapter of the circuit board comprise a conductive pattern.

4. The microphone according to claim 3, wherein the conductive pattern in the contact adapter is continuous.

5. The microphone according to claim 3, wherein the at least one contact adapter comprises a plurality of adapters provided on a plurality of longer sides of the case, and the conductive patterns in the contact adapters are intermittent.

6. The microphone according to claim 1, wherein the case is composed of metal.

7. The microphone according to claim 1, wherein the case is composed of resin, and the inner wall of the case is plated and conductive.

8. The microphone according to claim 1, further comprising a tailpiece attached to an end in the longitudinal direction of the case, the tailpiece having a shape fitted to the cross section of the case.

9. The microphone according to claim 8, wherein the case has a substantially circular cross section, and the tailpiece has a substantially elliptical cross section.

10. The microphone according to claim 8, wherein the tailpiece comprises a plug fitted in the case, the plug having a substantially elliptical cross section having a major axis slightly longer than the inner diameter of the case.

11. The microphone according to claim 8, wherein the tailpiece comprises a resilient material.

12. The microphone according to claim 8, wherein the tailpiece comprises:

a plug fitted in the case; and grooves along the center line of the cross section of the plug, the grooves receiving the circuit board.

* * * * *